United States Patent [19]

Arceneaux et al.

[11] Patent Number: 4,867,376

[45] Date of Patent: Sep. 19, 1989

[54] AIR CONTROL SYSTEM

[76] Inventors: Henry M. Arceneaux, 909 Garden St., Morgan City, La. 70380; Harry R. Cross, P.O. Box 2565, Morgan City, La. 70381

[21] Appl. No.: 920,237

[22] Filed: Oct. 17, 1986

[51] Int. Cl.[4] ..... F24F 7/00

[52] U.S. Cl. ..... 236/49.2; 236/44 R; 236/49.3; 237/80; 98/1

[58] Field of Search ..... 98/1, 42.15, 42.16, 98/42.19, 119; 237/80; 236/44 R, 44 C, 49; 49/1

[56] References Cited

U.S. PATENT DOCUMENTS

| | | | |
|---|---|---|---|
| 2,372,164 | 3/1945 | Woodhams | 98/2.14 |
| 3,202,079 | 8/1965 | Steiner | 98/42.19 |
| 3,230,859 | 1/1966 | O'Hea | 98/42.15 |
| 3,643,582 | 2/1972 | Mochida | 98/86 |
| 3,913,344 | 10/1975 | Holloway et al. | 236/44 C |
| 3,923,096 | 12/1975 | Van der Lely | 165/48.1 |
| 4,090,437 | 5/1978 | Bogaert | 98/42.15 |
| 4,520,959 | 6/1985 | Kolt | 98/42.16 |
| 4,559,867 | 12/1985 | Van Becelaere et al. | 98/1 |
| 4,625,626 | 12/1986 | Aalto et al. | 98/1 |

*Primary Examiner*—Harry B. Tanner

*Attorney, Agent, or Firm*—C. Emmett Pugh

[57] ABSTRACT

An air control device, having a panel which opens and closes in response to changes in environmental conditions in a building, preferably is sized to replace a ceiling tile in a conventional drop ceiling. The air control device may be responsive, for example, to a change in temperature of the air space above a conventional drop ceiling, raising the panel when the temperature drops to near freezing, allowing air from below the drop ceiling to commingle with air above the drop ceiling. A support in rolling contact with the underside of the panel maintains the panel open, the support including a fusible fire link which fails or fractures in the event of a fire, thus allowing the panel to fall, insuring that the fire rating of the ceiling is not compromised.

8 Claims, 10 Drawing Sheets

AIR CONTROL SYSTEM

BACKGROUND OF THE INVENTION

1. Field of the Invention

The present invention relates generally to freeze protection, fire protection and environmental control systems.

2. General Background of the Invention

Many buildings today have sprinkler systems therein for fire protection. These sprinkler systems usually comprise a piping system located in an air space above a drop ceiling, and a number of sprinkler nozzles extending below the drop ceiling. The drop ceiling usually has good insulating and fire-resisting values, and thermally separates this upper air space from the air space below the ceiling which, in most areas, is heated in the winter and cooled in the summer. In colder climates, where the temperature outside the building often drops below freezing during the winter, there is the danger that the water in the piping system will freeze, rendering the sprinkler system inoperable, and making the building especially vulnerable if a fire should break out while the system is frozen. In addition, frozen water pipes can be extremely disadvantageous even if no fire breaks out, because the water, which expands as it freezes, may burst the pipes. When the ice in the pipes thaws out, allowing water to escape from the broken pipes, severe water damage can occur to the building and to its contents.

Various methods have been used to attempt to keep the water in sprinkler systems, in the upper air space above drop ceilings, from freezing. One method is to insulate the piping—this may be effective if the air in the upper air space drops below freezing only briefly. However, since insulation only slows the transfer of heat, if the temperature of the upper air space should stay below freezing for any extended period of time, the water in the pipes will freeze.

Another method currently in use is to install a circulation pump in the sprinkler system. These pumps usually circulate water in the main line only, leaving branch lines unprotected against freezing.

Heaters are sometimes installed in the upper air space above the drop ceiling. In most states, however, this constitutes a violation of fire codes.

Another method of protecting sprinkler systems from freezing involves removing a number of ceiling tiles from the drop ceiling, thereby allowing the warm air below the ceiling to rise into the air space above the ceiling. Some persons do this only when a freeze is anticipated, while others remove a number of ceiling tiles when the winter begins, and do not replace them until all danger of freezing is over for the year. While both of these last-mentioned methods are effective at keeping the sprinkler system from freezing, the disadvantages of such methods far outweigh the advantages. In the case where the tiles are removed for the duration of the winter, a tremendous amount of energy is wasted, as the upper air space is heated whether the temperature outdoors is below freezing or not. In the case where the tiles are removed only when a freeze is anticipated, a sudden unpredicted drop in temperature can catch the building operator unaware, and cause the pipes to freeze. In both cases, the fire rating of the ceiling is lost, fire insurance may be voided, and, in most locations, removal of ceiling tiles is a violation of the fire code.

In view of the potential hazards which occur when sprinkler systems freeze, and the various inadequate, unsafe and/or prohibited methods mentioned above now employed to prevent sprinkler systems from freezing, it can be seen that there exists a need for a safe, economical, effective system to prevent sprinkler systems in buildings from freezing.

SUMMARY OF THE INVENTION

The present invention provides a device and system which may be used to help prevent water pipes, in air spaces above drop ceilings, from freezing in cold weather.

The device of the present invention comprises an air control unit which may be used in a drop ceiling in place of a standard ceiling tile. The air control unit includes a pivotal panel, which fits in sealing engagement on a body member, which is preferably sized to replace a standard ceiling tile in a drop ceiling. A panel-raising member is used to raise the pivotal panel to allow exchange of air between the air spaces above and below the drop ceiling. The panel-raising member is preferably attached to an electric motor which raises or lowers the pivotal panel in response to environmental conditions above or below the drop ceiling.

When used to protect water pipes in the upper air space above the drop ceiling, the motor is controlled by a temperature sensing means comprising a thermostat or a thermocouple located above the drop ceiling. The temperature sensing means causes the motor to raise the panel when the temperature of the upper air space drops dangerously close to freezing, thereby allowing warm air from beneath the ceiling to warm the space above the ceiling. When the temperature in the upper air space rises to a safe degree, the panel is lowered, preventing exchange of air between the spaces above and below the ceiling.

The device of the present invention can also be used to maintain the relative humidity of the air space below the ceiling at a comfortable level. In this instance, a humidistat located below the ceiling controls the electric motor which raises and lowers the pivotal panel. The humidistat causes the panel to raise when the relative humidity reaches an unacceptable level, allowing dry air in the upper air space to commingle with the air below the ceiling. When the relative humidity of the air below the ceiling reaches an acceptable level, the humidistat causes the panel to lower, preventing further mixing of the air on either side of the ceiling.

Whether being used to control the temperature of the air space above the ceiling, or to control the relative humidity of the air below the ceiling, the member which raises the panel comprises a fusible fire link which melts in the event of a fire, so that the panel drops to a closed position and the integrity of the fire rating of the ceiling is not compromised.

The use of the device of the present invention to help prevent water pipes, in air spaces above drop ceilings, from freezing is especially advantageous in that it provides effective freeze protection, automatically, only when necessary. It is an adequate system which is relatively economical and worry-free as compared to previously-known methods of freeze protection. Furthermore, the fusible fire link in the panel-raising member insures that the fire rating of the ceiling will be maintained in the event of a fire.

A number of the devices of the present invention can be used in a comprehensive environmental control system in a building to help prevent sprinkler systems from freezing and to maintain the relative humidity of the air below the ceiling at a comfortable level.

It is an object of the present invention to provide a device which selectively allows communication between an air space above a ceiling and an air space below the ceiling in response to environmental conditions either above or below the ceiling.

It is another object of the present invention to provide such a device which is controlled automatically by an environmental sensing means.

A further object of the present invention is to provide a device which allows air above a drop ceiling to communicate with air below a drop ceiling, while maintaining the fire rating of the ceiling in the event of a fire.

It is a further object of the present invention to provide an air control unit which is sized to replace a ceiling tile in a conventional drop ceiling.

Another object of the present invention is to provide an air control unit which responds automatically to temperature changes in the air space above a drop ceiling to allow warm air below the ceiling to mix with air above the ceiling to help insure that water pipes above the drop ceiling will not freeze in cold weather.

BRIEF DESCRIPTION OF THE DRAWINGS

For a further understanding of the nature, objects and advantages of the present invention, reference should be had to the following detailed description, taken in conjunction with the accompanying drawings, in which like reference numerals denote like elements, and wherein.

DETAILED DESCRIPTION OF THE PREFERRED EMBODIMENTS

Figure 1:
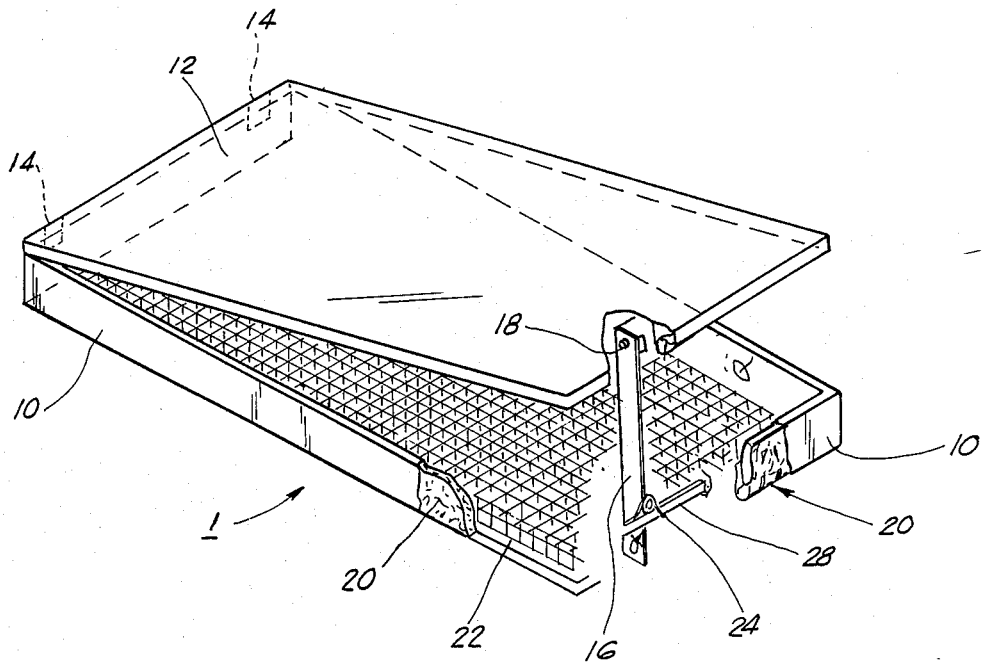
FIG. 1 is a perspective, partially cut-away view of a first embodiment of the device of the present invention.
Figure 2:
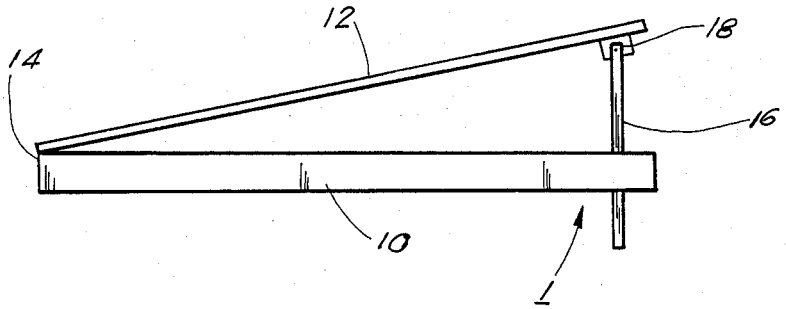
FIG. 2 is a side elevational view of the device illustrated in FIG. 1.

Referring now to the drawings, a first embodiment of the present invention, air control device 1, is shown in FIGS. 1 and 2. Air control device 1 includes a base or body member 10 having an upper, generally quadrilateral planar panel 12 pivotally connected at one end to the body by conventional means such as hinges 14. At an end of panel 12 opposite hinges 14 is a hand-manipulable member in the form of a support bar 16, which is pivotally attached to the panel 12 at 18.

Insulation 20 is provided on the walls of body 10, and an additional layer of insulation (not shown) is attached to the underside of panel 12. The insulation preferably has at least a Class 1 fire rating so as to have the same fire rating class as most ceilings. Thus, when the panel 12 is closed, the thermal and the fire rated integrity of the ceiling in which air control device 1 is installed is assured. If desired, the insulation beneath panel 12 may be of increased thickness so as to engage the top edges of the base or body member 10 to form a near air tight seal therewith.

If desired, the bottom of body 10 may be provided with a grating 22. Grating 22 allows free passage of air into the assembly, and the grating resembles that used in the base of conventional light fixtures used in drop ceilings; thus, air control device 1 will have an aesthetic, attractive appearance from beneath.

Figure 3:
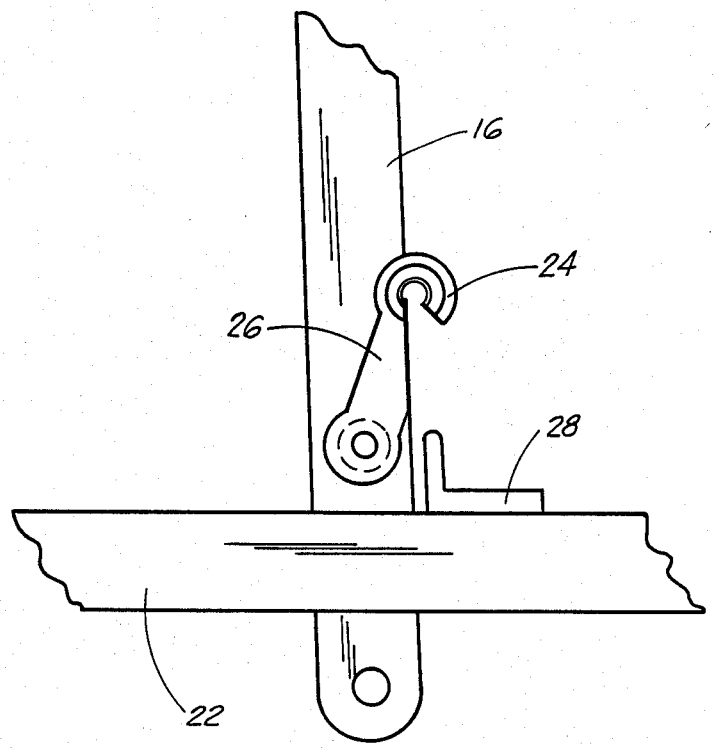
FIG. 3 is a detail of the device shown in FIGS. 1 and 2.

As shown most clearly in FIG. 3, the bottom portion of the panel support bar 16 is provided with a latch 24, which is rigidly attached to support bar 16 and has a fusible link 26 incorporated therein. Latch 24 is configured to engage a support rest 28, which is mounted atop a portion of grating 22. Thus, in the event of a fire, fusible link 26 will melt, latch 24 will fracture and panel 12 will close by pivoting downwardly under its own weight to engage the base or body member 10.

As noted previously, the device of the present invention is intended for use in an otherwise conventional drop ceiling or the like (not shown) which includes a grid-like network of supporting rails into which conventional ceiling tiles are dropped. Such drop ceiling tiles are, ordinarily, approximately two feet by four feet in dimension. Conveniently, the body 12 is approximately the same size, so that it may simply be dropped into the support rails in place of a conventional ceiling tile. Although most ceiling tiles have dimensions as previously noted, the dimensions of body 10 can be selected to fit various other ceiling configurations.

Figure 4:
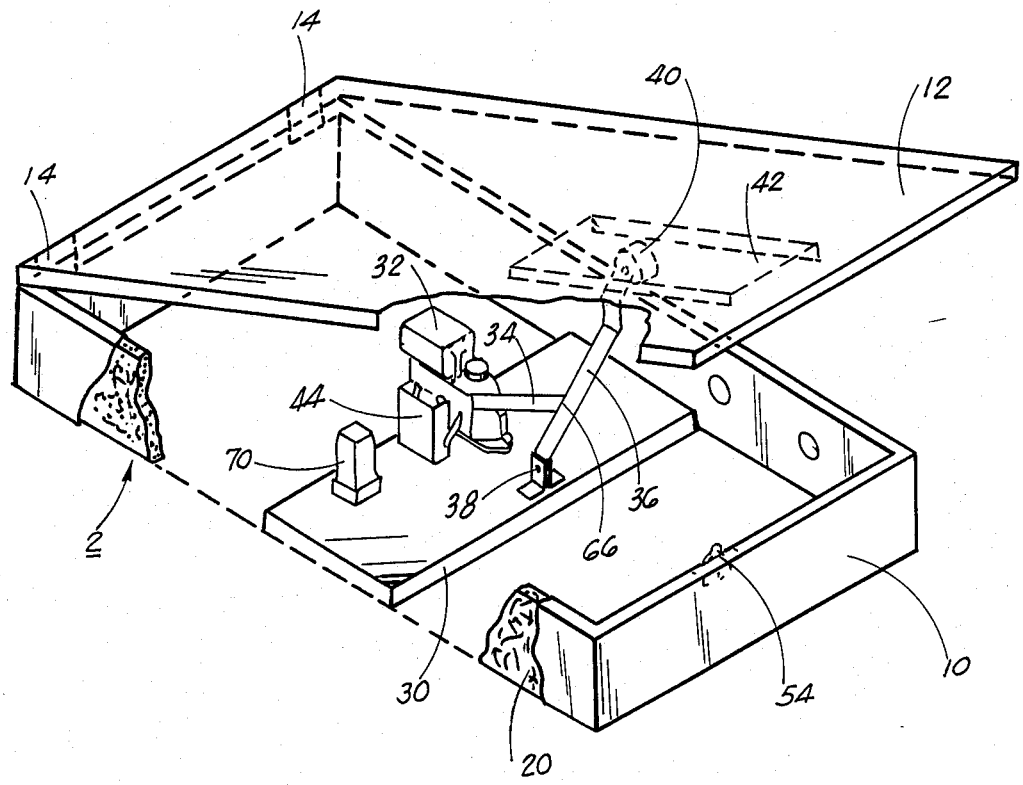
FIG. 4 is a perspective view of a second embodiment of the present invention, parts being broken away to show interior details.

A second, automatically operable embodiment of the present invention, air control device 2, is illustrated in FIG. 4. Air control device 2 incorporates the major features of the first embodiment, namely, a base or body member 10, a top panel 12 and hinges 14 for pivotally interconnecting panel 12 with body 10. A transversely arranged support platform 30 is mounted in the bottom of body 10 and may be a part of or rest on top of the grating 22 illustrated in FIG. 1. A reversible electric motor 32 is mounted on transverse platform 30 and is operatively connected to a raising arm assembly 34 which is, in turn, pivotally connected to a support arm 36. Support arm 36 is pivotally mounted to platform 30 at pivot 38.

The free, distal end of support arm 36 engages panel 12 in abutting contact only and is not in any way interconnected with panel 12. The distal end of support arm 36 includes a freely rotatable roller 40, which rides in a track 42 mounted on the underside of panel 12. Thus, for example, when the motor 32 is actuated to raise support arm 36 through raising arm assembly 34, roller 40 engages track 42 to lift the panel 12 to the position illustrated in FIG. 4. Since support arm 36 is not positively interengaged with panel 12, the panel 12 may be manually raised and lowered independently of the operation of motor 32, raising arm assembly 34 and support arm 36.

Figure 5:
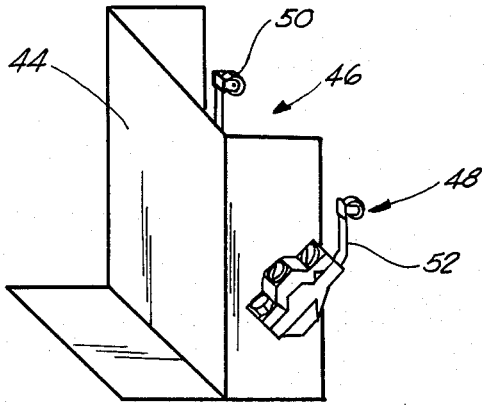
FIG. 5 is a detail of the device illustrated in FIG. 4.

As shown in FIGS. 4 and 5, platform 30 further includes a bracket 44 upon which are mounted a pair of microswitches 46 and 48, which control the operation of reversible motor 32 in a manner to be described below. The first microswitch 46 includes a first microswitch arm 50, and the second microswitch 48 includes a second microswitch arm 52. As shown in FIG. 4, the front wall of body 10 may include a microswitch 54 along the upper latch thereof, which may be spring-loaded when in a closed position. Switch 54 is arranged to be contacted by panel 12, when panel 12 is lowered upon body 10. Thus, when panel 12 is opened, switch 54 completes a circuit to energize a status light (not shown in FIG. 4—indicated at 56 in FIG. 6). Status light 56 provides a visual indication to any observer that panel 12 is in the open position, and may be present in device 2, or may be located in a control room of the building.

Figure 7:
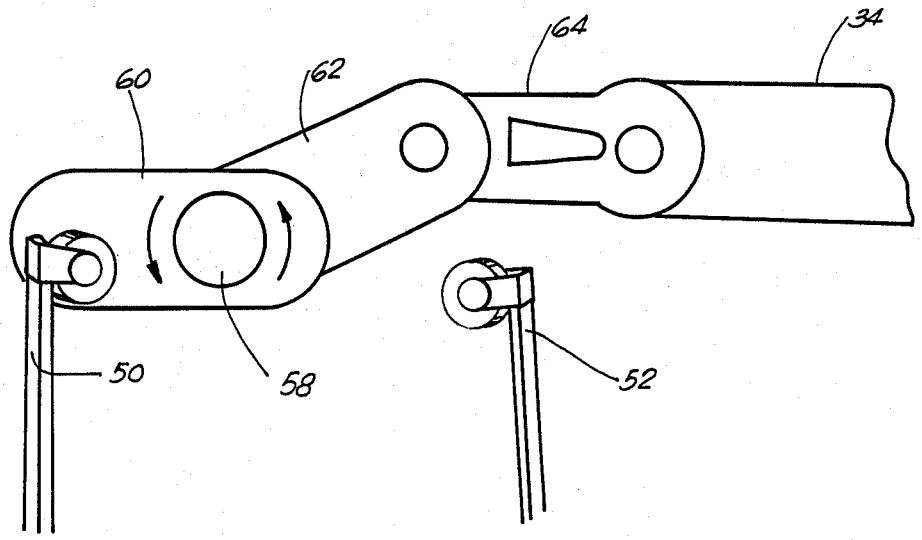
FIG. 7 and 8 are detail views, showing the operation of the linkage, including a fusible link incorporated with the support illustrated in the device shown in FIG. 4.
Figure 8:
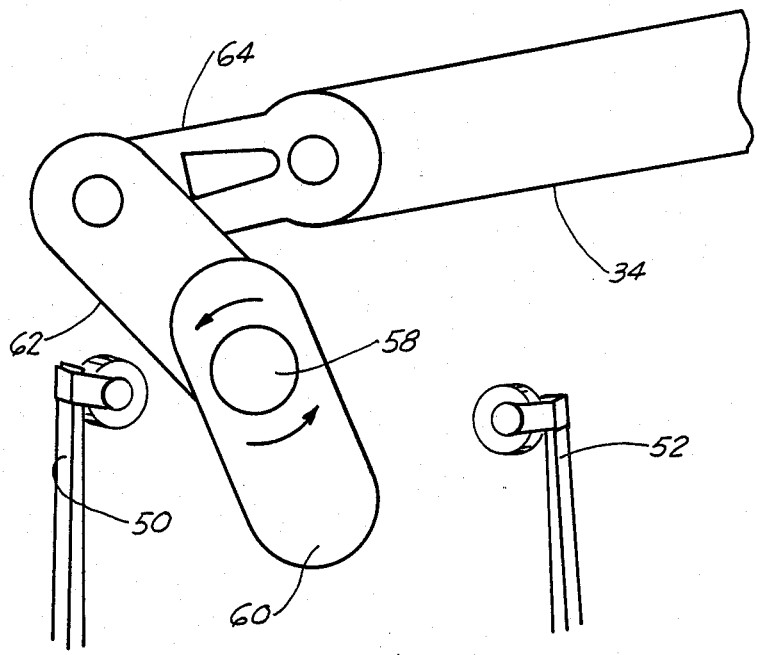

Referring now to FIGS. 7 and 8, the interrelationship of electric motor 32 and raising arm assembly 34, which operates support arm 36 and thus serves to open and close panel 12, may now be explained. The reversible electric motor includes an output motor shaft 58, to which an operating cam 60 is rigidly fixed. A link arm 62 is also rigidly attached to motor shaft 58 and a fusible fire link 64 is pivotally connected both to a free end of link arm 62 and the rear of the main portion of raising arm assembly 34, as shown in FIGS. 7 and 8. The free end of raising arm 34 is pivotally attached at 66 to support arm 36, as illustrated in FIG. 4.

When motor 32 is actuated to rotate shaft 58 counterclockwise, cam 60 and link arm 62 are also rotated counterclockwise, as shown in FIG. 8, and raising arm 34 is moved to the left, in the view shown in FIGS. 4, 7 and 8, through the pivoting interconnection of fusible fire link 64 with raising arm assembly 34 and link arm 62. With reference to FIG. 4, this causes support arm 36 to ascend. Panel 12 is thus opened, with roller 40 riding along track 42 underneath panel 12. When a predetermined degree of opening of panel 12 is reached, cam 60 strikes second microswitch arm 52 which operates microswitch 48 to interrupt current to motor 32 and thus stop its operation. Conversely, when motor 32 is actuated to close panel 12, motor shaft 58 rotates clockwise, relative to the view shown in FIGS. 7 and 8, until cam 60 strikes first microswitch arm 50 of microswitch 46. At this point, the raising arm assembly will be in the position illustrated in FIG. 7 and panel 12 will be closed against body 10. When cam 60 strikes first microswitch arm 50, electric current to motor 32 is interrupted and the motor ceases operation.

Figure 6:
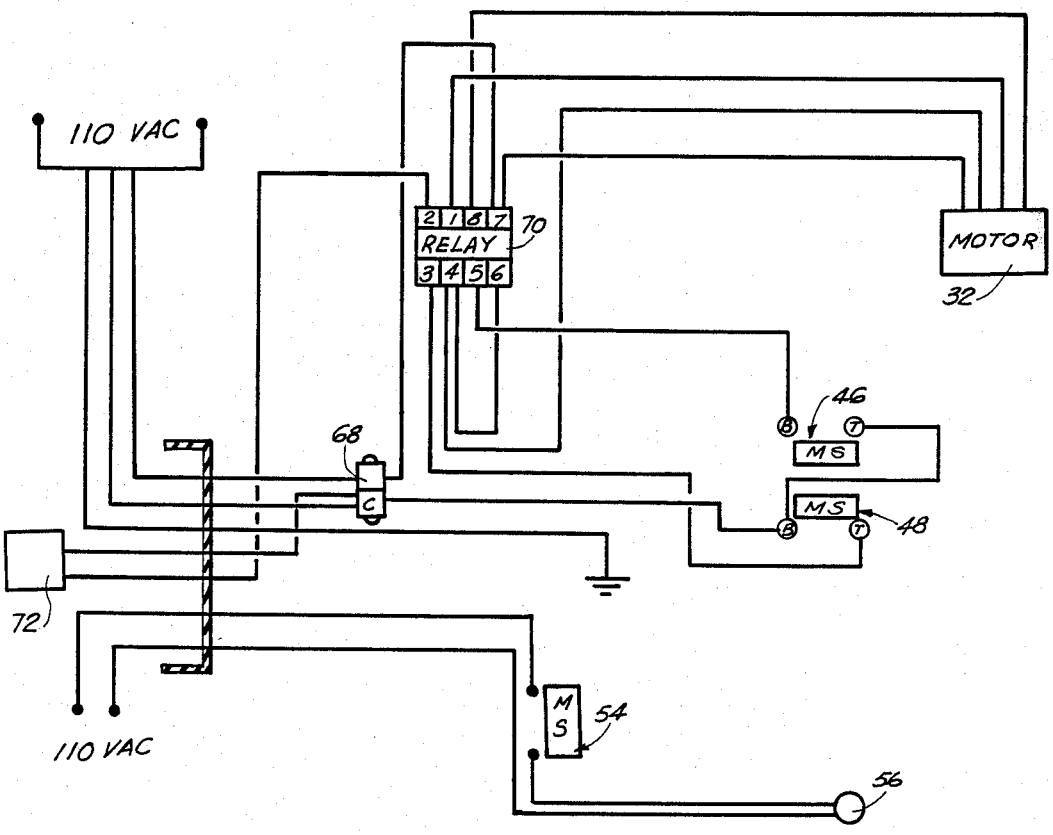
FIG. 6 is a schematic wiring diagram which may be used in the device shown in FIG. 4.

An example of wiring that might be used with air control device 2 is illustrated in FIG. 6. A standard source of 110 VAC is provided, including a ground wire, through a terminal block 68 and an eight-pin relay 70 (relay 70 is also illustrated in FIG. 4). The automatic system for raising and lowering panel 12 is controlled by an environmental sensing means 72. Environmental sensing means 72 may be a temperature sensing means such as a thermostat or a thermocouple, or it may be a humidistat. If environmental sensing means 72 is a temperature sensing means, it is located in the air space above a conventional drop ceiling, a portion of which is shown at 74 in FIG. 15. As explained above, the air space above a conventional drop ceiling 74 may have therein pipes filled with water, particularly in the event an automatic fire sprinkler system is present. It is desirable to prevent any such pipes from reaching a freezing temperature; thus, the thermostat or thermocouple 72 may be preset to activate the system when a temperature of about 32° F. (0° C.) is reached. When such a condition is sensed, thermostat or thermocouple 72 serves to close circuitry thus to activate motor 32 and move the raising arm assembly 34 to the left, as shown in FIG. 7. This causes support arm 36 to ascend, lifting and opening panel 12. With panel 12 open, warm air from below drop ceiling 74 may ascend into the air space above drop ceiling 74 and warm the upper air space; thus, any pipes in the upper air space will not freeze.

It is very important that the fire rated integrity of ceiling 74 be maintained in the case of a fire. This means that, in the event of a fire, the ceiling 74 must be closed. Thus, should a fire occur with panel 12 in an open position, the fusible fire link 64 will melt, fracturing raising arm assembly 34. With the interconnection between support arm 36 and electric motor 32 thus broken, panel 12 is free to fall of its own weight against now freely-pivotal support arm 36. It will fall to a closed position against body 10, and thus the fire rated integrity of the ceiling 74 is assured.

When the air space above drop ceiling 74 has warmed sufficiently, thermostat or thermocouple 72 senses the condition and causes electric motor 32 to operate to rotate motor shaft 58 in a clockwise direction, thus allowing panel 12 to close in the manner previously explained.

Environmental sensing means 72 may, instead of being a thermostat or thermocouple, be in the form of a humidistat positioned in the air space below drop ceiling 74. When a predetermined condition of relative humidity is reached, humidistat 72 operates to open panel member 12 in the manner just explained when the environmental sensing means is a thermostat or a thermocouple. With panel 12 open, air in the upper and lower air spaces on either side of ceiling 74 commingles and the humidity in the lower air space returns to a desirable level. When this level is reached, humidistat 72 operates to close panel member 12 in the manner just explained when the environmental sensing means 72 is a thermostat or thermocouple.

As explained above, panel 12 is free of any positive interengagement with support arm 36. Thus, panel 12 may be manually opened or raised independently of any operation of motor 32. This might be deemed necessary in order to access the space above drop ceiling 74 for any reason, such as repair or maintenance of equipment located thereabove, or to allow heated air to rise into the air space above ceiling 74 when desired. To further facilitate this operation, the embodiments shown in FIGS. 1 and 4 may be combined. Thus, a second support arm such as 16 (FIG. 1) with latch 24 and support rest 28 might be added to the embodiment shown in FIG. 4. Preferably, the additional support bar 16 in this embodiment will have a sufficient length such that the distance between latch 24 and pivotal connection 18 is longer than the effective operating length of support arm 36. In other words, the panel member 12 would be opened a sufficient distance so as to be unaffected by any unintentional or inadvertent operation of electric motor 32.

Figure 9:
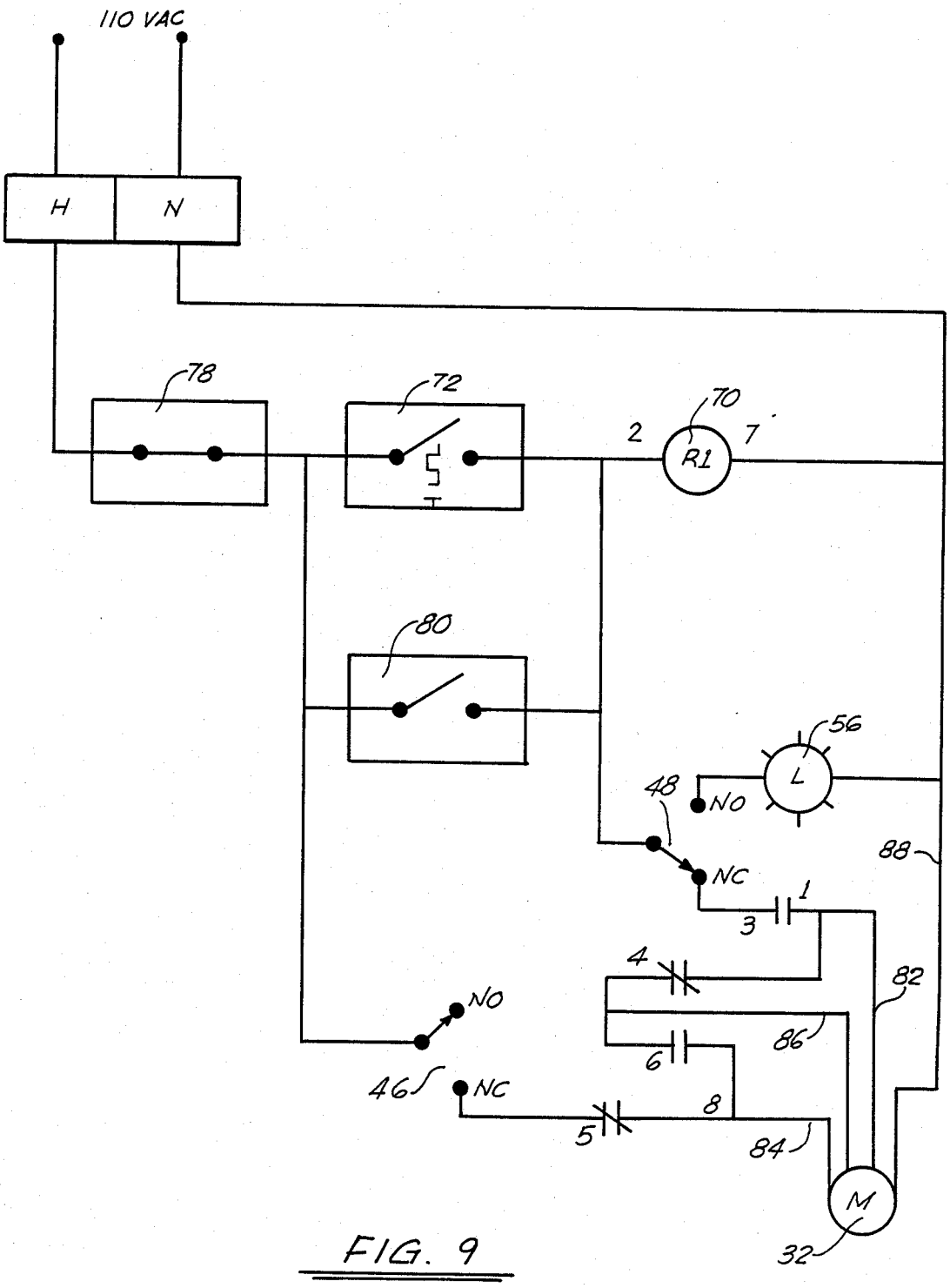
FIG. 9 is another schematic wiring diagram which may be used with the device illustrated in FIG. 4.

FIG. 9 illustrates another embodiment of a wiring diagram and electrical components that may be used with the embodiment of the invention illustrated in FIG. 4. With the circuitry in the condition illustrated in FIG. 9, panel 12 is in a closed position, sealed against body 10. When the humidistat, thermocouple or thermostat 72 senses a condition in a manner previously described, the circuitry of environmental sensing means 72 is closed, which energizes relay 70, which changes the state of the relay switches from that shown in FIG. 9, and which causes electricity to flow through the on/off switch 78 through environmental sensing means 72 to microswitch 48, pins 1 and 3, wire 82, wire 84, relay pins 6 and 8, wire 86, and wire 88 to neutral.

With reference to FIG. 7 and 8, motor shaft 58 is caused to rotate in a counterclockwise direction and open panel 12, in a manner previously described. At the completion of the opening operation, cam 60 contacts arm 52 of microswitch 48 to open switch 48. Switch 46 is now closed due to the separation of cam 60 from switch arm 50 of microswitch 46. Panel 12 is now fully opened and current flows from on/off switch 78 through switch 48, status light 56 and to neutral. Status light 56 is thus lit and any observer can appreciate that panel 12 is open.

When the appropriate temperature or humidity condition is sensed by environmental sensing means 72 as previously explained, environmental sensing means 72 opens, stopping the flow of current through relay 70, which returns the relay switches to the state shown in FIG. 9. Current then flows through the on/off switch to the closed microswitch 46, relay pins 5 and 8, wire 84, wire 82, relay pin 4, wire 86, and wire 88 to neutral. This causes motor shaft 58 to rotate clockwise, in the sense of FIGS. 7 and 8, and allows panel 12 to close, as previously described. This causes microswitch 48 to close, since cam 60 is released from switch arm 52. As parts return to the position illustrated in FIG. 7, and panel 12 is closed, arm 50 of microswitch 46 is contacted by cam 60, thus opening microswitch 46. Thus, all components are returned to the condition illustrated in FIG. 9. Test switch 80 is wired in parallel with environmental sensing means 72, and overrides environmental sensing means 72 when it is desired to test the system.

Figure 10:
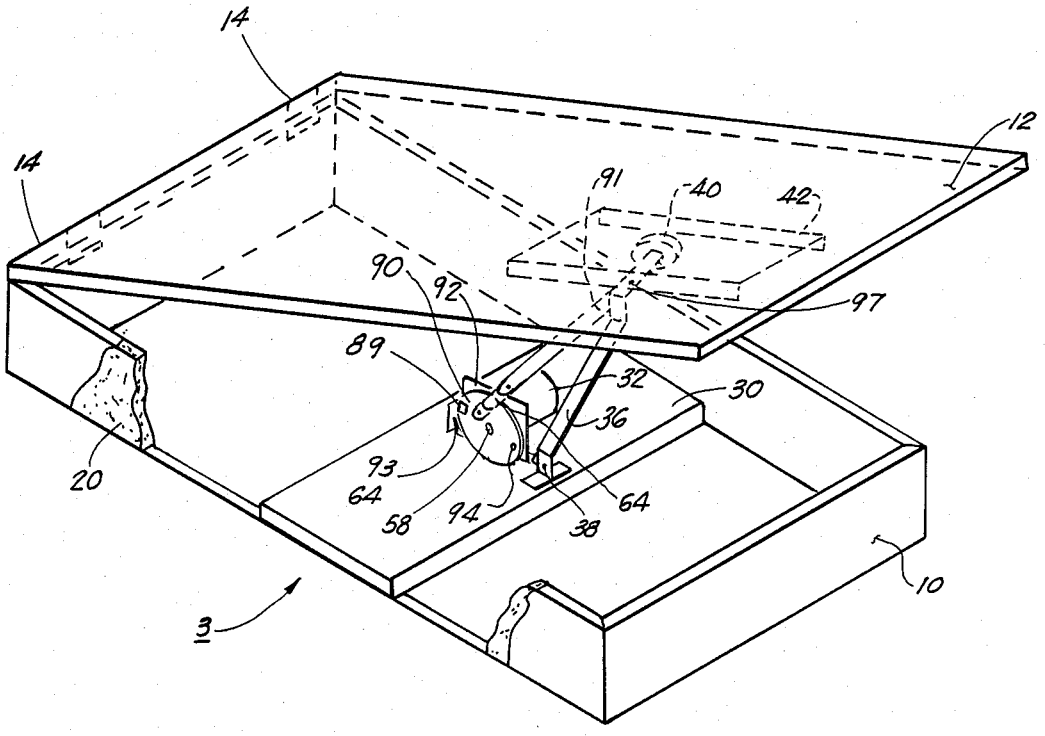
FIG. 10 is a perspective view of the preferred embodiment of the present invention.
Figure 11:
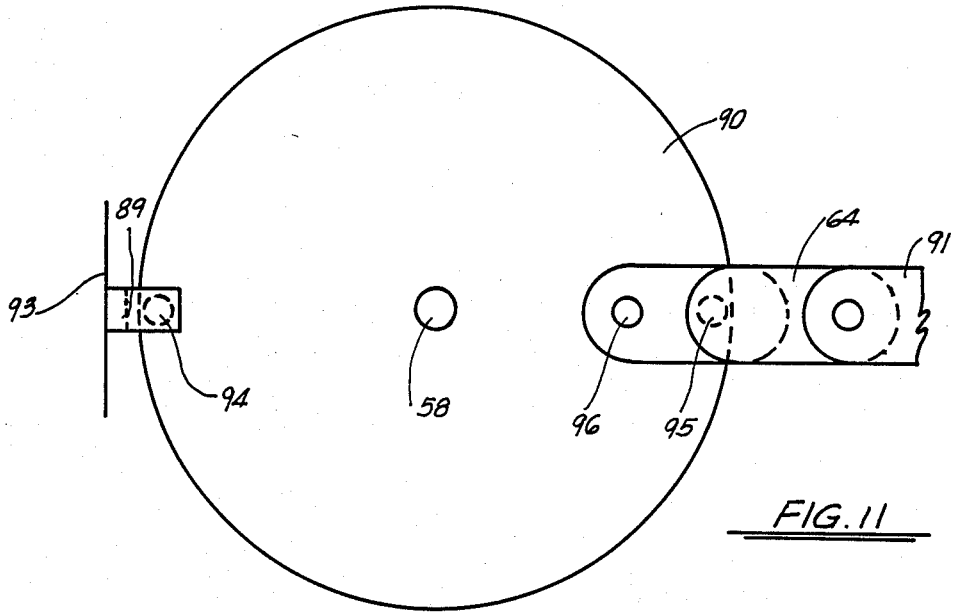
FIGS. 11, 12 and 13 are detail views of various parts of the device shown in FIG. 11.
Figure 12:
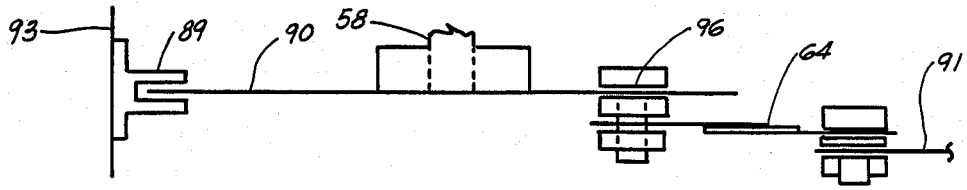
Figure 13:
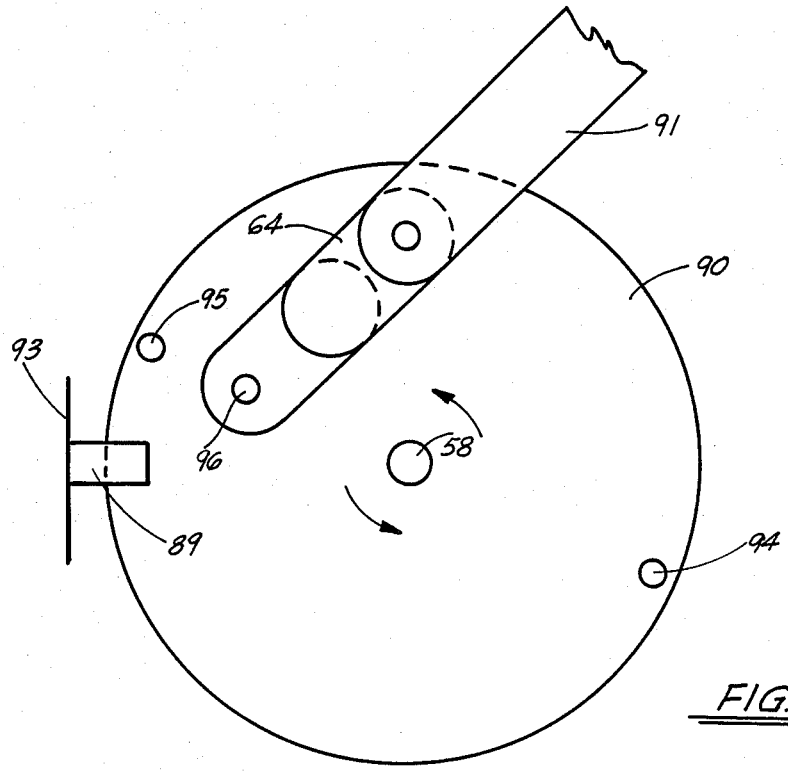

The preferred embodiment of the present invention, air control device 3, is illustrated in FIG. 10. Air control device 3 is similar to air control device 2 (FIG. 4) and differs primarily in the manner in which motor 32 is interconnected with support arm 36 and in the manner in which motor 32 is stopped. A disc 90 is rigidly fixed to shaft 58 of motor 32. One end of an arm raising assembly 91 is pivotally connected at 97 to support arm 36. The other end of arm raising assembly 91 is pivotally connected to disc 90 at 96 (FIGS. 11–13). Arm raising assembly 91 has a fusible fire link 64 therein which melts in the event of a fire, disconnecting support arm 36 from the control of motor 32. Disk 90 has two holes, 94 and 95, therein. When either hole 94 or hole 95 lines up with switch means 89 during rotation of disc 90, operation of motor 32 is caused to stop. Switch means 89 may comprise, for example, an optical switch means, such as a light emitting diode (LED) and a phototransistor, or it may comprise a spring-loaded pressure switch, and is mounted on a bracket 93.

The operation of air control device 3, like the operation of air control device 2, is controlled by an environmental sensing means 72 (not shown in FIG. 10). When the environmental sensing means 72 detects a condition in which it is necessary to raise panel 12, it causes motor 32 to rotate disc 90 in a counterclockwise manner, as illustrated in FIG. 13, moving arm raising assembly 91 to the left, thereby raising support arm 36, which raises panel 12. When hole 95 lines up with switch means 89, switch means 89 causes motor 32 to stop, thereby stopping rotation of disc 90 and leaving panel 12 in a raised position, allowing air above and below the ceiling to mix. When the environmental sensing means detects a condition in which panel 12 may be lowered, it causes motor 32 to rotate disc 90 in a clockwise direction, returning disk 90 to the position shown in FIGS. 11 and 12, and causing panel 12 to lower. Rotation of disc 90 ceases when hole 94 lines up with switch means 89, as switch means 89 at this time causes motor 32 to stop.

As with air control device 2 shown in FIG. 4, environmental sensing means 72 may comprise a humidistat or a temperature sensing means, such as a thermostat or thermocouple, and is responsive either to the relative humidity of the air below the drop ceiling or the temperature in the air space above the drop ceiling.

Figure 14:
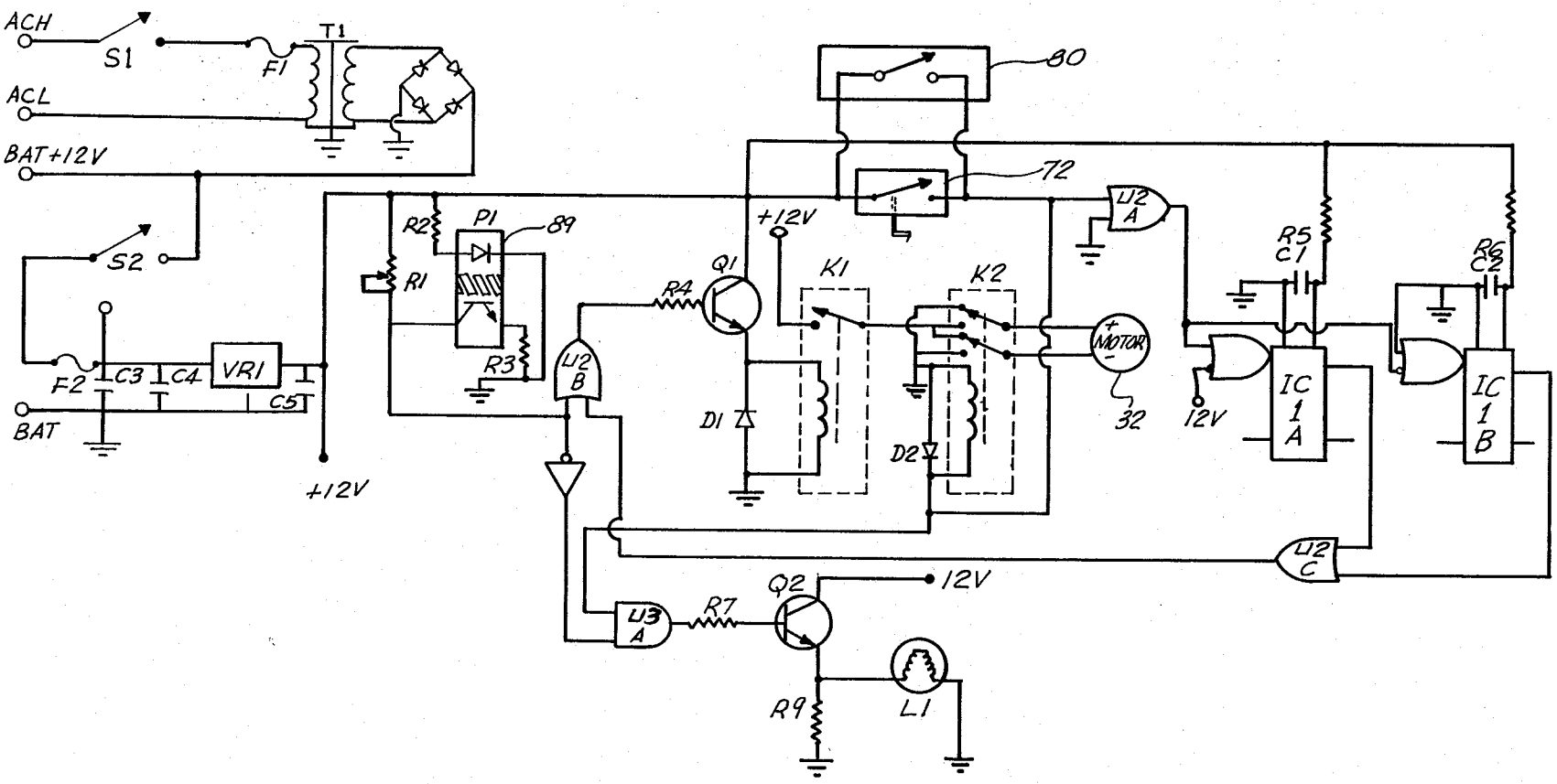
FIG. 14 is a schematic wiring diagram for use with the embodiment of the invention shown in FIG. 10.

FIG. 14 shows a wiring diagram which may be used with air control device 3 when motor 32 is a reversible DC motor and switch means 89 comprises a light emitting diode and a phototransistor. In this case, switch means 89 is deactivated when either of holes 94 or 95 in disc 90 is positioned such that the LED optically communicates with the phototransistor via hole 94 or hole 95 in disc 90. The use of low voltage DC to operate the air control device is advantageous in that, while most fire codes require AC wires in commercial buildings to be run in conduit, low voltage DC wiring can usually be run without conduit, making installation of the air control device more economical. As in the circuitry shown in FIG. 9, a test switch 80 is connected in parallel with environmental sensing means 72 to allow the system to be tested when desired.

Figure 15:
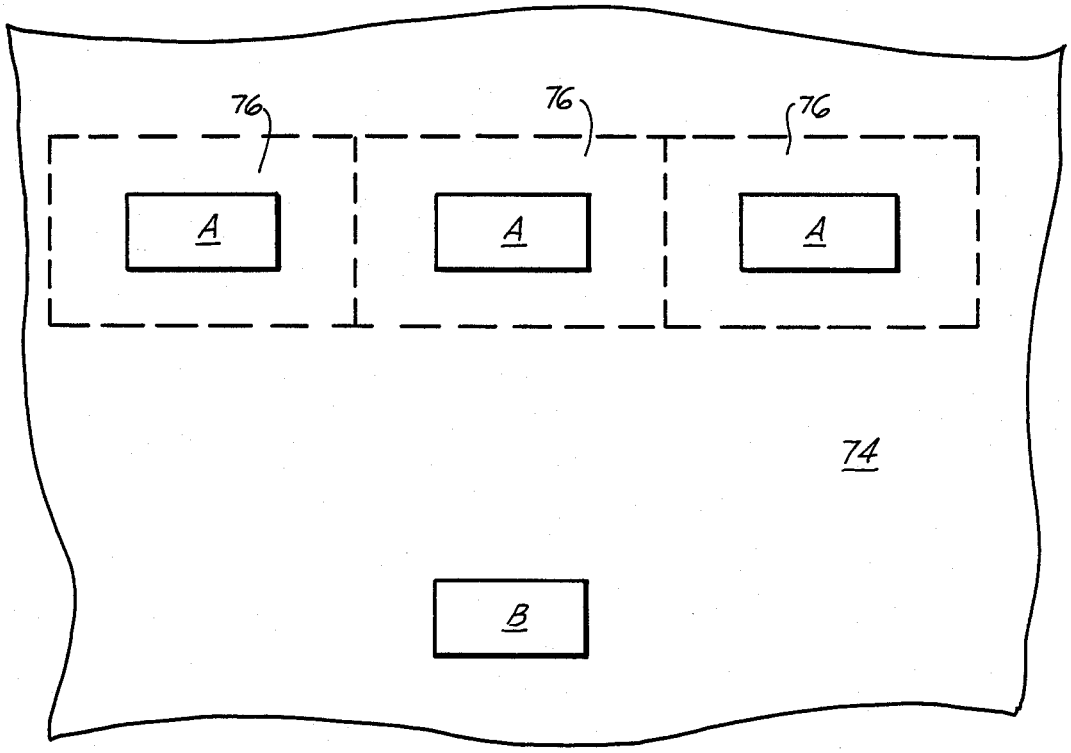
FIG. 15 is a schematic, partial plan view showing one layout of a number of devices of the present invention installed in a conventional drop ceiling.

FIG. 15 diagramatically illustrates, in part, a typical installation employing the teachings of this invention. In this case, the air control devices of the present invention would be installed in the drop ceiling of a convenience store, supermarket, or the like. Such a store might have one or more conventional open coolers as shown at 76. Such coolers are likely to raise the relative humidity in the area to an inordinate level. Accordingly, the air control devices of this invention employing an environmental sensing means in the form of a humidistat would be located, as needed, above coolers 76. One or more air control devices having sensing means in the form of a thermostat or a thermocouple could conveniently be located elsewhere in drop ceiling 74. In FIG. 15, air control devices as shown in FIGS. 4 or 10 employing humidistats are shown at A, and an air control device using a temperature sensing means is designated by "B".

It should be noted that means other than an electric motor may be used to raise and lower panel 12. Such means could be, for example, pneumatic, hydraulic, chemical, or bimetallic operations. In view of these and other changes which may be made to the embodiments disclosed herein without departing from the spirit or scope of the present invention, I hereby pray that my rights to the present inVention be limited only by the following claims.

I claim:

1. An environmental control system for use in an environmental zone divided by a drop ceiling or the like into an upper air space above the ceiling and a lower air space below the ceiling, said environmental control system, comprising at least one air control device having:

a generally planar panel;

pivotally mounting means for pivotally mounting said panel at one side thereof within the drop ceiling, allowing said panel to be pivoted from a closed, sealing position separating the upper and lower air spaces, to an open position with the air spaces in free communication with each other;

raising means for raising the panel to the open position, said raising means including a support means having a fusible fire link therein, the support means maintaining said panel in said open position after actuation of the raising means, said support means having a first end contacting said panel, said support means including a fusible fire link which fails when the temperature of the air surrounding said fusible fire link reaches a predetermined temperature, causing said support means to fail and said panel to pivot downwardly to said closed, sealing position; and environmental sensing means located in the environmental zone for causing actuation of said raising means to raise the panel when a predetermined environmental condition is sensed; wherein:

said raising means comprises electric motor means;

said environmental sensing means comprises a temperature sensing means located in the upper air space preset to operate said raising means when a temperature of about 32 degrees F. (0 degrees C.) is sensed;

said raising means further comprises a rotatable disc to which a second end of said support means is pivotally connected, rotation of said disc in a first direction causing said panel to raise to said open position, rotation of said disc in a second direction causing said panel to lower to said closed position, wherein holes are provided in said disc, rotation of said disc being caused to cease when one of said holes aligns with a switch means, said switch means comprising a source of light and a light detecting means; and wherein said air control device is dimensioned to replace a ceiling tile in a conventional drop ceiling.

2. The environmental control system as recited in claim 1, further comprising a plurality of said air control devices, a preselected number of said devices each having environmental sensing means comprising a humidistat and an additional preselected number of said devices each having environmental sensing means comprising a temperature sensing means.

3. An environmental control apparatus for use in a zone divided into an upper space and a lower space, said apparatus comprising:

a panel adapted for movement between an open position allowing free air communication between the upper and lower spaces and a closed position preventing free air communication between the upper and lower spaces;

movement means for moving said panel into the open position, comprising a pivotal support means engaging the panel;

control means for controlling movement of said pivotal support means depending on temperature conditions in the upper space, including a temperature sensing means; and limiting means for limiting the movement of said pivotal support means, comprising an optical switch means; wherein:

said pivotal support means includes a fusible fire link therein which fails when the temperature of the air surrounding said fusible fire link reaches a predetermined temperature, thereby causing said pivotal support means to fail and said panel to pivot downwardly to said closed position;

said optical switch means comprises a light emitting diode and a phototransistor;

said environmental control apparatus further comprising a rotatable disc to which an end of said pivotal support means is pivotally attached, rotation of said disc in a first direction causing said panel to said open position, rotation of said disc in a second direction causing said panel to lower to said closed position, wherein holes are provided in said disc, rotation of disc being caused to cease when one of said holes aligns with said optical switch means; and said environmental control apparatus is dimensioned to replace ceiling tile in a conventional drop ceiling.

4. For use in an environmental zone divided by a drop ceiling or the like into an upper air space above the ceiling and a lower air space below the ceiling, an environmental control system comprising at least one air control device having:

a generally quadrilateral, planar panel:

mounting means for pivotally mounting said panel at one side thereof within said drop ceiling, said panel being pivotable from a closed, sealing position separating the upper and lower air spaces, to an open position with the air spaces in free communication with each other;

raising means for raising the panel to the open position, said raising means including support means having a fusible fire link therein, the support means maintaining said panel in said open position after actuation of the raising means, the support means having a distal end contacting the panel and being free of any other interconnection therewith, said panel being pivotable to an open position independently of the operation of said raising means, said support means including a fusible fire link which fails when the temperature of the air surrounding said fusible fire link reaches a predetermined temperature, causing said support means to fail and said panel to pivot downwardly to said closed, sealing position; and environmental sensing means located in the environmental zone for causing actuation of said raising means to raise the panel when a predetermined environmental condition is sensed; wherein:

said raising means further comprises electric motor means;

said environmental sensing means comprises a humidistat;

the distal end of said support means includes roller means for rolling contact against said panel when said raising means is actuated;

said panel includes track means for receiving said roller means;

said humidistat is located in the lower air space and is preset to operate said raising means when a predetermined level of relative humidity is sensed;

said air control device further comprises second raising means, second supporting means and second fusible fire link means which comprise a hand manipulated member pivotally connected to a side of said panel opposite said one side of said panel, the second fusible fire link means being in the form of a latch means for maintaining said panel in the open position;

said air control device further comprises lowering means for moving said panel from the open position to the closed, sealing position, said raising means and said lowering means comprising reversible, electric motor means; and said air control device further comprises electric circuit means for interconnecting said motor means and said environmental sensing means with a source of electric current, said current means further including switch means wired and parallel with said environmental sensing means for overriding the operation of said environmental sensing means.

5. An environmental control method for a building of controlling at least the temperature aspects of an environmental zone formed between a floor and a true ceiling, which zone is divided by a drop ceiling or the like into an upper air space above the drop ceiling and the true ceiling and a lower air space below the drop ceiling, which upper air space includes a series of pipe sections carrying liquid located below the true ceiling, which liquid is subject to freezing if exposed to relatively low temperatures caused when the ambient is below freezing, comprising the following steps:

(a) providing an environmental control system, including at least one air control device having a generally planar panel;

pivotally mounting means for pivotally mounting said panel at one side thereof within the drop ceiling, allowing said panel to be pivoted from a closed, sealing position separating the upper and lower air spaces to an open position with the air spaces in free communication with each other;

raising means for raising the panel to the open position, said raising means including a support means having a fusible fire link therein, the support means maintaining said panel in said open position after actuation of the raising means, said support means having a first end contacting said panel, said support means including a fusible fire link which fails when the temperature of the air surrounding said fusible fire link reaches a predetermined relatively high temperature, thereby causing said support means to fail and said panel to pivot downwardly to said closed, sealing position; and temperature sensing means located in the upper area of the environmental zone for providing a signal indicating that there should be actuation of said raising means to raise the panel when a potentially liquid freezing temperature in the upper area is sensed;

(b) using said temperature sensing means to sense when a potentially liquid freezing temperature in the upper area is becoming present, threatening the pipes; and (c) when such potentially freezing temperature is sensed in the upper space, raising said panel to allow the air below the drop ceiling to flow up into the upper area above the drop ceiling, potentially warming the pipes and preventing their freezing; and (d) when a relatively high temperature is present, such as may occur due to a fire, using the melting point of the fusible fire link to cause the fusible fire link to fail, thereby causing said panel to close.

6. The method of claim 5, wherein there is included the further step(s) of:

(i) providing an electric motor with mechanical linkages in associated with said panel capable of raising said panel; and (ii) using said signal to automatically actuate said electric motor causing said panel to be automatically raised when said signal is present.

7. The method of claim 5, wherein the drop ceiling is made up of ceiling tiles supported by a support grid and wherein there is included the further step(s) of:

(i) dimensioning said air control device to fit in the same space occupied by the ceiling tile; and (ii) installing said air control device in the building by inserting it in the support grid in place of a ceiling tile to be supported and carried by the support grid.

8. The method of claim 5, wherein there is included the further step(s) of:

(i) providing in association with said raising means a humidistat;

(ii) utilizing said humidistat to automatically actuate said raising means to raise said panel when the humidistat senses that conditions exists that would make it desirable for there to be free air communication between said upper and lower spaces.

* * * * *